United States Patent [19]

Libassi

[11] Patent Number: 4,835,894

[45] Date of Patent: Jun. 6, 1989

[54] SAFETY DEVICE FOR AUTOMATIC FIREARMS

[76] Inventor: Jack Libassi, 568 Pyrite Dr., Rio Rancho, N. Mex. 87124

[21] Appl. No.: 203,854

[22] Filed: Jun. 7, 1988

[51] Int. Cl.[4] ..... F41C 27/00

[52] U.S. Cl. ..... 42/70.11

[58] Field of Search ..... 42/70.01, 70.11; 89/148

[56] References Cited

U.S. PATENT DOCUMENTS

| | | | |
|---|---|---|---|
| 2,997,802 | 8/1961 | Robbins | 42/70.01 |
| 3,193,959 | 7/1965 | Jaycox | 42/70.11 |
| 3,237,335 | 3/1966 | Kerr | 42/70.01 |
| 3,378,943 | 4/1968 | Valburg | 42/1 |
| 3,382,596 | 5/1968 | Rockwood | 42/70.01 |
| 3,605,311 | 9/1971 | Hermann | 42/70.11 |
| 3,634,963 | 1/1972 | Hermann | 42/1 N |
| 4,266,356 | 5/1981 | Uro | 42/70.11 |
| 4,528,765 | 7/1985 | Johnson | 42/1 LP |
| 4,603,498 | 8/1966 | Johnson | 42/70.11 |
| 4,654,992 | 4/1987 | Lavergne | 42/70.01 |

OTHER PUBLICATIONS

Gustaf, "Swede", *FFV Sports Inc.,* 1973.

*Primary Examiner*—Deborah L. Kyle
*Assistant Examiner*—Richard W. Wendtland
*Attorney, Agent, or Firm*—Henderson & Sturm

[57] ABSTRACT

A safety plug device (10) for the firing chambers (101) of firearms (100) such as pistols (100') and rifles (100'') wherein the safety plug device (10) comprises a stepped shoulder generally cylindrical plug member (13) having a tab member (16) with an enlarged flag portion (17) formed on its upper end; wherein, the plug member (13) and a portion of the tab member (16) are dimensioned to be received in the firing chamber (101) while flag portion (17) will project a substantial distance above the slide bolt mechanism (103) of the firearms (100) to indicate that the weapon is unloaded.

1 Claim, 2 Drawing Sheets

SAFETY DEVICE FOR AUTOMATIC FIREARMS

TECHNICAL FIELD

This invention relates in general to a safety device for firearms, and in particular to a safety device for automatic firearms such as pistols and rifles.

BACKGROUND OF THE INVENTION

As can be seen by reference to the following U.S. Pat. Nos.: 4,654,992; 4,528,765; 3,634,963; and 3,378,943 the prior art is replete with myriad and diverse safety devices for automatic firearms which bar the movement or loading of the chamber.

While the prior art constructions are more than adequate for the particular purpose and function for which they were specifically designed, they also suffer from a number of shared deficiencies. In general these prior art constructions are only designed for one particular type of automatic weapon and they are not particularly well suited or even adaptable for use between firearms in the same general class such as shoulder held weapons including rifles and shotguns, nor are the suitable between different classes of firearms such as shoulder held weapons and hand held weapons (e.g. pistols).

Given the fact that every year hundreds if not thousands of Americans are killed by supposedly "unloaded" weapons, there has existed a longstanding need among those individuals concerned with this particular problem for the creation of a simple and inexpensive safety plug device that will not only be effective for weapons in a given class of firearms, but will be equally effective for weapons in different classes of firearms.

Based on the foregoing situation, the primary considerations involved with the development of the present invention were centered around the provision of a solution to the deficiencies that have plagued the prior art constructions; in that they only directed their efforts to provide a solution for a single class of firearms.

BRIEF SUMMARY OF THE INVENTION

Briefly stated, the safety device that forms the basis of the present invention comprises in general: a plug unit and a flag unit; wherein, the plug unit comprises a stepped shoulder chamber member having a plurality of differently dimensioned cylindrical chamber portions that are configured to be received in the cartridge or shell chambers of different classes of firearms to fill the space normally occupied by a chambered round when the particular weapon is ready to be fired.

In addition, the flat unit comprises an upwardly projecting tab member disposed on one end of the plug unit; wherein the tab member not only provides a grasping surface to facilitate the insertion and removal of the safety plug device into longitudinal axial alignment with the bore of the chamber, but also provides by virtue of its presence, a visual indication to the person handling the weapon that there are no live rounds in the chamber of the particular firearm in question.

BRIEF SUMMARY OF THE DRAWINGS

These and other objects, advantages, and novel features of the invention will become apparent from the detailed description of the best mode for carrying out the preferred embodiment of the invention which follows; particularly when considered in conjunction with the accompanying drawings, wherein.

BEST MODE FOR CARRYING OUT THE INVENTION

Figure 1:
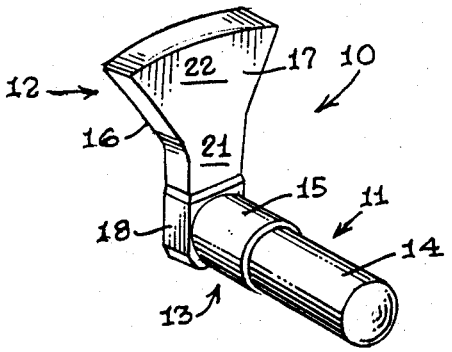
FIG. 1 is a perspective view of the safety plug device that comprises this invention.

As can best be seen by reference to the drawings and in particular to FIG. 1, the safety plug device that forms the basis of the present invention is designated generally by the reference numeral (10). The safety plug device (10) comprises in general: a plug unit (11) and a flag unit (12). These units will now be described in seriatim fashion.

Prior to embarking on a detailed description of the safety plug device (10) it should be understood that this invention is intended for use with firearms (100) having a firing chamber (101) in open communication with the elongated cylindrical bore (102) of the firearms (100); wherein the firearms generally comprise a pistol (100') and a rifle (100''). In addition, the pistol (100') depicted in the drawings specifically comprises a .45 caliber Colt brand ACP semi-automatic pistol, and the rifle depicted in the drawings specifically comprises an M-16 automatic rifle; however, this invention is not intended to be limited to those two specific firearms.

Figure 4:
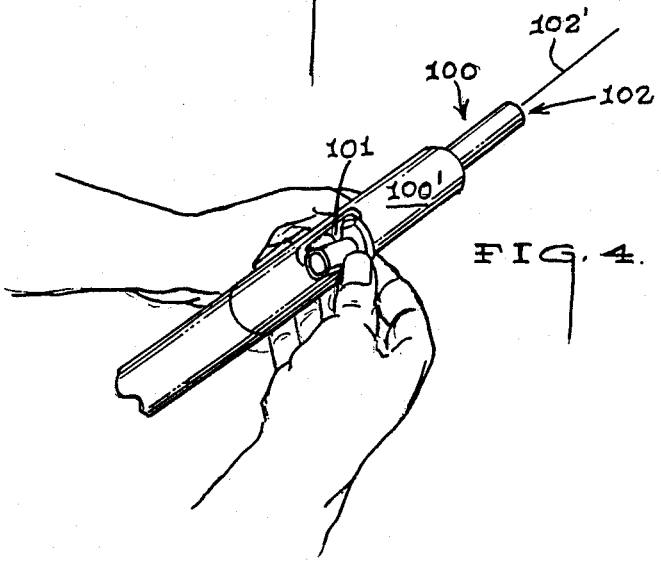
FIG. 4 is a detail view showing the device being inserted into an automatic pistol.
Figure 5:
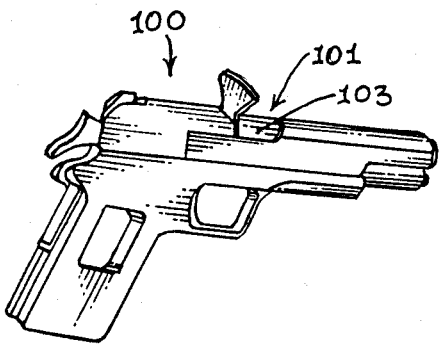
FIG. 5 is a detail view showing the device installed in an automatic pistol.
Figure 6:
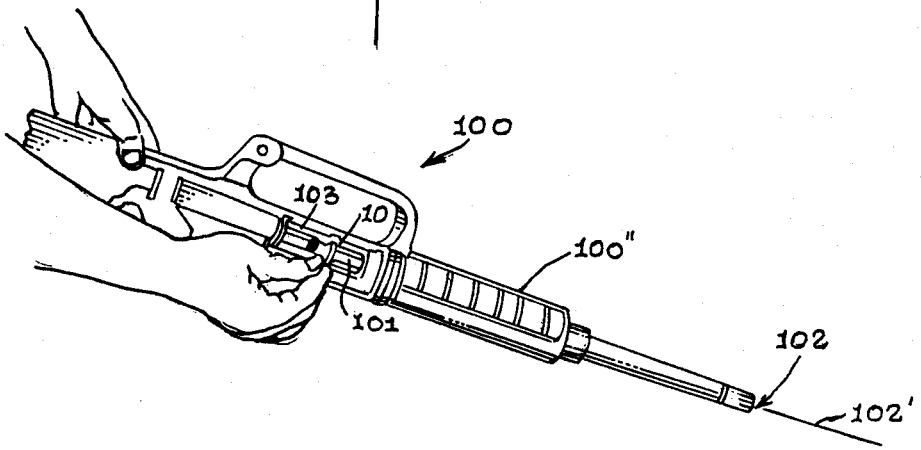
FIG. 6 is a detail view showing the device being inserted into an automatic rifle; and, FIG. 7 is a detail view showing the device installed in an automatic rifle.
Figure 7:
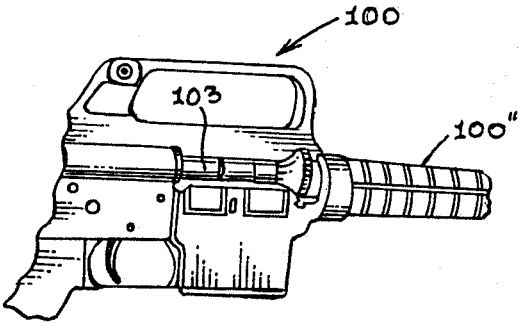

As can best be seen by reference to FIGS. 1, 4, and 6, the plug unit (11) comprises a stepped shoulder generally cylindrical plug member (13) having a reduced diameter leading cylindrical bore element (14) and an enlarged diameter trailing cylindrical bore element (15); wherein, the leading (14) and trailing (15) cylindrical bore elements are dimensioned to be received in different diameter firearm chambers (101); and, wherein the longitudinal axis of the generally cylindrical plug member (13) may be aligned with the longitudinal axis (102') of the bore (102) of a firearm (100).

Figure 2:
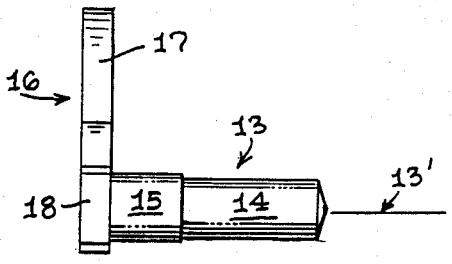
FIG. 2 is a side plan view of the device.
Figure 3:
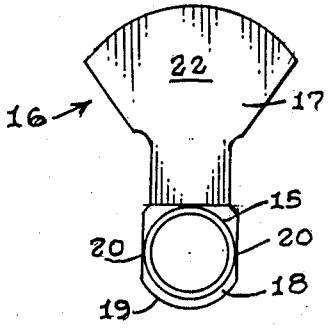
FIG. 3 is a front plan view of the device.

Turning now to FIGS. 1 thru 3, the tab unit (12) comprises an elongated generally flat contoured tab member (16) having an enlarged upper flat portion (17) and a reduced dimension lower portion (18); wherein, the lower portion (18) of the tab member (16) is rigidly secured to the enlarged diameter trailing bore element (15); and, wherein the tab member (16) is disposed in a generally perpendicular fashion to the longitudinal axis (13') of the generally cylindrical plug member (13).

As can best be seen particularly by reference to FIG. 3, the lower portion (18) of the tab member (16) is provided with an arcuate bottom surface (19) which extends below the plug member (13) and opposed flat sides (20); wherein, the width of the lower portion (18) of the tab member is approximately equal to the diameter of the enlarged diameter trailing bore element (15) of the plug member (13). In addition, the upper flag portion (17) of the tab member (16) is provided with a reduced width neck element (21) and an enlarged width fan element (22); wherein, the fan element (22) provides a gripping and force transmitting surface, whose purpose and function will be described presently.

As shown in FIGS. 4 thru 7, the safety plug device (10) is designed and dimensioned such that the combined length and width of the plug unit (11) and lower portion (18) of the tab unit (912) may be received in the firing chambers (101) of a variety of firearms (100) such as a pistol (100') and a rifle (100''). The insertion of the safety plug device (10) is accomplished by the retraction of the conventional spring loaded firearm slide bolt mechanism (103) to expose the interior of the firing chamber (101). At this juncture the top portion (17) of the tab member (16) is grasped to manipulate the plug member (13) into axial alignment with the longitudinal axis (102') of the bore (102) of the firearm (100). When this has been accomplished the spring loaded bolt mechanism (103) is released, to return to its normally closed position; wherein, the top portion (17) of the tab member (16) will project a substantial distance above the bolt mechanism (103); and the neck (21) of the tab member (16) will be positively engaged between the bolt mechanism (103) and the bolt mechanism seat (not shown).

In the preferred embodiment illustrated in FIGS. 1 thru 7, the reduced diameter leading bore element (14) is dimensioned to be received in the firing chamber (103) of a Colt brand M-16 automatic or semi-automatic rifle (100''); and, the enlarged diameter trailing bore element (15) is dimensioned to be received in both in the firing chamber (103) and the bore (102) of a Colt brand .45 caliber pistol (100').

It should also be noted that the safety plug device (10) is oriented towards the pistol bore (102) and away from the automatic rifle bore (102) in its operative mode of disposition relative to the two types of firearms (100'') and (100') respectively. This orientation is imposed on the safety plug device (10) due to the differential between the bores (102) of the different firearms (100'') and (100'). Furthermore, the lower portion (18) of the tab member (16) is provided with the generally flat relieved sides (20) such that the safety plug device (10) will accommodate the conventional bolt mechanism (103) of a pistol (100').

By now it should be obvious that the safety plug device (10) of this invention is dimensioned and configured to be received in the firing chambers (101) of certain pistols (100') and rifles (100''); wherein, the safety plug device (10) occupies the space within the firing chambers (101) that are normally occupied by a live round or cartridge (not shown) preparatory to firing the weapon (100). In this manner the unloaded condition of the weapon (100) can be immediately visually detected by the presence of the upper flag portion (17) of the tab member (16) projecting from the chamber bolt mechanism (103) of the particular firearm (100).

Having thereby described the subject matter of this invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A safety plug device for firearms characterized by a firing chamber, a cylindrical bore, a slide bolt mechanism, and including pistols and rifles wherein the safety plug device consists of:

a plug unit comprising a stepped shoulder generally cylindrical plug member having a reduced diameter leading cylindrical bore element and an enlarged diameter trailing cylindrical bore element; wherein, the reduced diameter leading cylindrical bore element is dimensioned to be received in the firing chamber of a pistol in one orientation of said plug unit and the reduced diameter leading cylindrical bore element and the enlarged diameter trailing cylindrical bore element are dimensioned to be received respectively in the firing chamber and the cylindrical bore of a rifle in an opposite orientation to said one orientation of said plug unit; and, a tab unit secured to one end of the enlarged diameter trailing cylindrical bore element of the plug member; wherein, the tab unit comprises an elongated generally flat tab member disposed in a generally perpendicular fashion to the longitudinal axis of the generally cylindrical plug member; and, wherein the tab member comprises: an enlarged generally flat upper flag portion provided with a reduced width neck element and an enlarged width fan element; and, a reduced dimension lower portion; wherein the tab member is dimensioned such that the enlarged upper flag portion will project a substantial distance above the slide bolt mechanism of a pistol and a rifle, when the plug unit is disposed within the firing chamber of those respective firearms.

* * * * *